US010422167B2

(12) United States Patent
Medina Huerta et al.

(10) Patent No.: US 10,422,167 B2
(45) Date of Patent: Sep. 24, 2019

(54) PUSH/PULL HANDLE OPERATING SYSTEM FOR A MOTOR VEHICLE DOOR

(71) Applicant: FORD GLOBAL TECHNOLOGIES, LLC, Dearborn, MI (US)

(72) Inventors: Mario Alejandro Medina Huerta, Mexico City (MX); Ernesto Zepeda Lopez, Ciudad Lopez Mateos (MX); Jorge Arturo Ortiz Flores, Mexico City (MX); Nathali Vasquez Henao, Mexico City (MX)

(73) Assignee: Ford Global Technologies, LLC, Dearborn, MI (US)

( * ) Notice: Subject to any disclaimer, the term of this patent is extended or adjusted under 35 U.S.C. 154(b) by 247 days.

(21) Appl. No.: 15/486,984

(22) Filed: Apr. 13, 2017

(65) Prior Publication Data

US 2018/0298653 A1 Oct. 18, 2018

(51) Int. Cl.

| | |
|---|---|
| ***E05F 1/10*** | (2006.01) |
| ***E05B 85/16*** | (2014.01) |
| ***E05B 79/12*** | (2014.01) |
| *E05B 1/00* | (2006.01) |

(52) U.S. Cl.

CPC ..... *E05B 85/16* (2013.01); *E05B 79/12* (2013.01); *E05B 2001/0076* (2013.01)

(58) Field of Classification Search

CPC ..... E05Y 2900/531; E05Y 2201/22; E05Y 2201/68; E05F 15/646; E05F 3/224; E05F 7/00; E05F 15/75; E05D 15/10; E05B 85/16; E05B 81/76; E05B 81/00; E05B 81/42; E05B 85/10; E05B 1/0038; E05B 2001/0076; E05B 1/00; E05B 85/18; E05B 85/14

USPC ..... 49/394, 388, 381, 386, 395, 397, 399, 49/400; 294/336.3, DIG. 22, DIG. 41, 294/DIG. 68

See application file for complete search history.

(56) References Cited

U.S. PATENT DOCUMENTS

| | | | | |
|---|---|---|---|---|
| 5,681,068 | A * | 10/1997 | Kleefeldt | E05B 13/005 292/336.3 |
| 5,803,516 | A * | 9/1998 | Hempel | E05B 77/52 292/223 |
| 6,106,036 | A | 8/2000 | Okada et al. | |
| 6,123,371 | A * | 9/2000 | Fisher | E05B 77/265 292/201 |
| 6,234,041 | B1 * | 5/2001 | Larabet | E05B 85/16 74/523 |

(Continued)

FOREIGN PATENT DOCUMENTS

| | | |
|---|---|---|
| EP | 2687654 A2 | 1/2014 |
| EP | 1966892 B1 | 4/2015 |

OTHER PUBLICATIONS

English Machine Translation of EP1966892B1.

*Primary Examiner* — Chi Q Nguyen

(74) *Attorney, Agent, or Firm* — Jason Rogers; Vichit Chea; King & Schickli, PLLC

(57) ABSTRACT

An operating system for a motor vehicle door includes a handle that is displaceable between a latching position, a first unlatching position and a second unlatching position. The operating system also includes a latch mechanism including a latch and a cooperating receiver. The operating system further includes a mechanical connection feature connecting the handle to the latch whereby the motor vehicle door may be unlatched by displacing the handle.

20 Claims, 4 Drawing Sheets

(56) References Cited

U.S. PATENT DOCUMENTS

| | | | | |
|---|---|---|---|---|
| 7,182,392 | B2 * | 2/2007 | Sawajiri | E05B 83/38 292/32 |
| 8,282,142 | B2 * | 10/2012 | Fannon | E05B 79/12 292/336.3 |
| 8,720,116 | B1 | 5/2014 | Ahmad | |
| 8,757,686 | B2 * | 6/2014 | Ishida | E05B 85/14 292/336.3 |
| 8,833,810 | B2 * | 9/2014 | Koizumi | E05B 77/06 292/336.3 |
| 8,959,964 | B2 * | 2/2015 | Hidaka | E05B 79/06 292/336.3 |
| 9,347,253 | B2 | 5/2016 | Shibayama et al. | |
| 2002/0040551 | A1 | 4/2002 | Zhou | |
| 2004/0094974 | A1 | 5/2004 | Song | |
| 2004/0162945 | A1 * | 8/2004 | King | G06F 11/006 711/122 |
| 2004/0232710 | A1 * | 11/2004 | Jooss | E05B 81/78 292/336.3 |
| 2005/0151635 | A1 | 7/2005 | Burkat et al. | |
| 2014/0123716 | A1 * | 5/2014 | Hidaka | E05B 79/06 70/91 |
| 2014/0292005 | A1 * | 10/2014 | Bendel | E05B 77/06 292/336.3 |

* cited by examiner

PUSH/PULL HANDLE OPERATING SYSTEM FOR A MOTOR VEHICLE DOOR

TECHNICAL FIELD

This document relates generally to the motor vehicle equipment field and, more particularly, to a push/pull handle operating system for a motor vehicle door and a related method of unlatching a motor vehicle door that provide for more convenient and user-friendly operation.

BACKGROUND

Today's motor vehicles are generally equipped with a handle which is pulled to unlock the locking mechanism of the motor vehicle door thereby releasing the door and allowing the user to open the door of the vehicle in order to access the interior. Although pull handles of this type exhibit many positive characteristics, they do require detailed and precise hand movements which the user may not be able to perform easily under all circumstances. For example, when a user is carrying several items in the arms and needs to open the motor vehicle door, pulling a door handle becomes problematic. The user would be required to set some things down, pull the handle, open the door and pick those things up and finally get into the car. This is an inconvenient, time-consuming and overcomplicated task under the circumstances. Setting items down in the rain, snow or a damp environment may also not be acceptable.

This document relates to a new and improved handle operating system for a motor vehicle which allows a user to unlock the locking mechanism of the motor vehicle door by either pushing or pulling. When one approaches the vehicle carrying objects in both hands, the user may push the handle in order to open the door and this may be done without setting those objects down.

SUMMARY

In accordance with the purposes and benefits described herein, an operating system for a motor vehicle door comprises: (a) a handle displaceable between a latching position, a first unlatching position and a second unlatching position, (b) a latch mechanism including a latch and a cooperating receiver and (c) a mechanical connection feature connecting the handle to the latch whereby the motor vehicle door may be unlatched by displacing the handle.

The handle may further include a first pivot, a first cam surface and a first biasing element biasing the handle toward the latching position. The mechanical connection feature may include a mechanical cam having a second cam surface engaging the first cam surface. The mechanical cam may be displaced between a first position and a second position. The mechanical cam may also include a second pivot and a second biasing element biasing the mechanical cam toward the second position.

The mechanical connection feature may also include a link having a first end connected to the mechanical cam and a second end connected to the latch. The latch may include a third pivot. The latch may be displaceable between a door latching position in engagement with the receiver and a door unlatching position free of the receiver. In addition, the operating system may further include an actuator to swing the motor vehicle door open when the latch is in the unlatching position.

Consistent with the above description, a motor vehicle comprises a chassis, a door carried on the chassis and displaceable between a closed position and an open position and an operating system for the door. That operating system includes (a) a handle displaceable between a latching position, a first unlatching position and a second unlatching position, (b) a latch mechanism including a latch and a cooperating receiver and (c) a mechanical connection feature connecting the handle to the latch whereby the door may be unlatched by displacing the handle.

The handle, the latch and the mechanical connection feature may all be carried on the door and the cooperating receiver may be carried on the chassis. The handle may include a first pivot, a first cam surface and a first biasing element biasing the handle toward the latching position.

The mechanical connection feature may include a mechanical cam having a second cam surface engaging the first cam surface. The mechanical cam may be displaceable between a first position and a second position. Further, the mechanical cam may include a second pivot and a second biasing element biasing the mechanical cam toward the second position.

The mechanical connecting feature may include a link having a first end connected to the mechanical cam and a second end connected to the latch. The latch may include a third pivot and may be displaceable between a door latching position in engagement with the receiver and a door unlatching position free of the receiver.

The operating system may further include an actuator to swing the motor vehicle door open when the latch is in the unlatching position. The latching position may be between the first unlatching position and the second unlatching position of the handle. Further, the handle may pass through a support carried on the door.

In accordance with yet another aspect, a method is provided for unlatching a motor vehicle door including a pivoting handle. That method comprises pivoting the pivoting handle from a latching position either in a first direction to a first unlatching position or in a second direction to a second unlatching position and unlatching a latch of the door via a mechanical connection feature. Still further, the method may include pushing on the pivoting latch to unlatch the door. The method may include pulling on the pivoting handle to unlatch the door. The method may also include opening the door when unlatched by an automatic door opening feature.

In the following description, there are shown and described several preferred embodiments of the operating system, the motor vehicle incorporating that operating system and the related method of unlatching a motor vehicle door. As it should be realized, the operating system, the motor vehicle and the method are capable of other, different embodiments and their several details are capable of modification in various, obvious aspects all without departing from the operating system, motor vehicle and method as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the operating system, the motor vehicle and the related method and together with the description serve to explain certain principles thereof.

Figure 1:
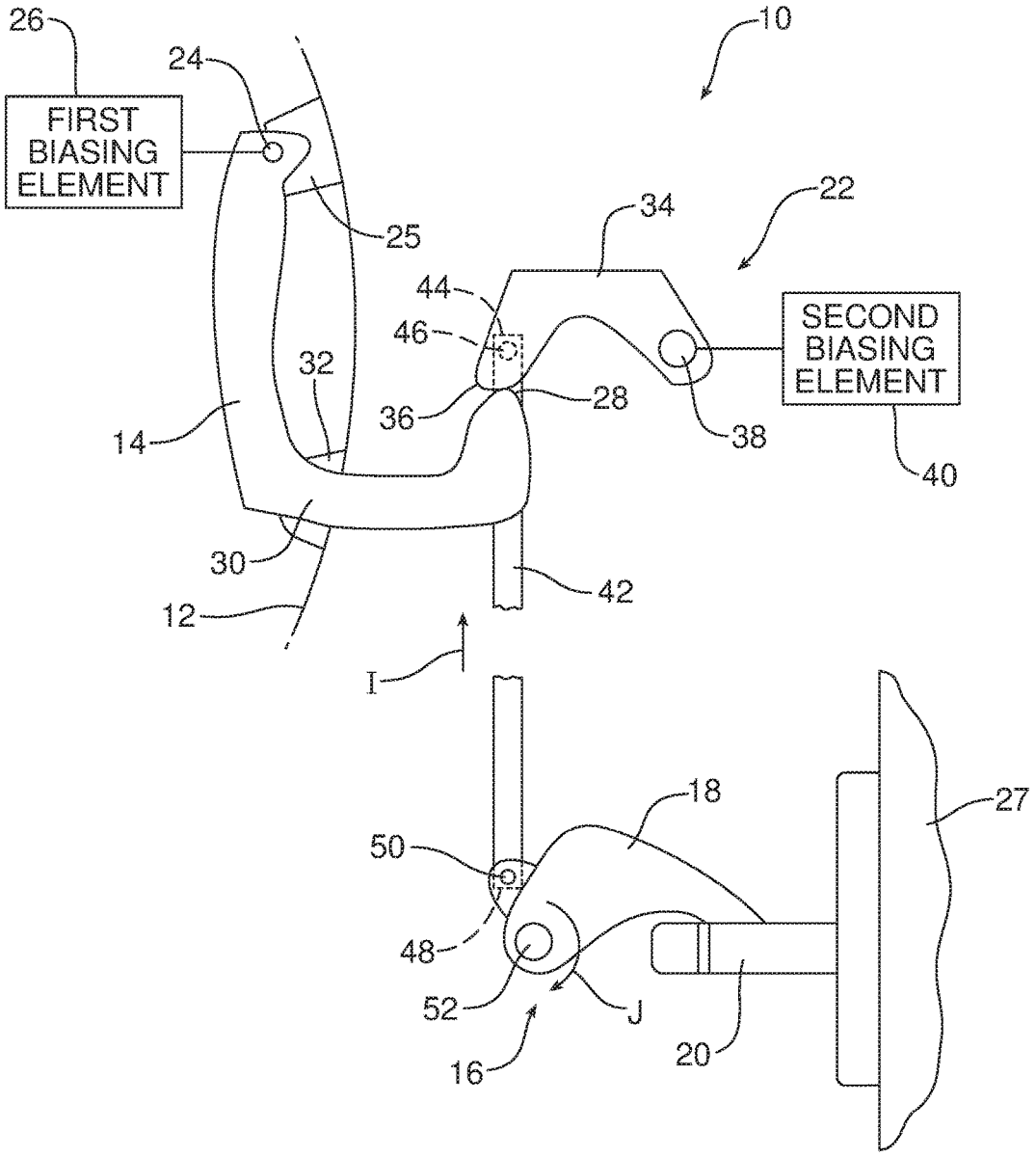
FIG. 1 is a schematic illustration of the operating system showing the door in a closed and fully latched position.

Reference will now be made in detail to the present preferred embodiments of the operating system, the motor vehicle and the method, examples of which are illustrated in the accompanying drawing figures.

DETAILED DESCRIPTION

Reference is now made to FIGS. 1-4 illustrating the new and improved operating system 10 for a motor vehicle door 12. The operating system 10 includes (a) a handle 14, (b) a latch mechanism 16, including a latch 18 and a cooperating receiver 20, and (c) a mechanical connection feature 22 connecting the handle to the latch whereby the motor vehicle door 12 may be unlatched by displacing the handle. The handle 14, the latch mechanism 16 and the latch 18 are all carried on the door 12. The receiver 20 is carried on the frame or chassis 27. As will be apparent from the following description, the operating system 10 is a significant convenience feature allowing the motor vehicle door 12 to be unlatched and opened by either pulling or pushing upon the handle 14.

The handle 14 includes a first pivot 24 that pivotally connects the handle to a standoff 25 carried on the motor vehicle door 12. The handle 14 is displaceable between a latching position illustrated in FIG. 1, a first unlatching position illustrated in FIG. 2 and a second unlatching position illustrated in FIG. 3. A first biasing element 26, such as a torsion spring concentrically received around the first pivot 24, functions to bias the handle toward the latching position illustrated in FIG. 1.

The first pivot 24 is provided at a proximal end of the handle 14. A first cam surface 28 is provided at a distal end of the handle. An intermediate portion 30 of the handle 14 passes through a support 32 provided on the door 12. That support 32 supports the handle 14 as it is displaced between positions.

Figure 2:
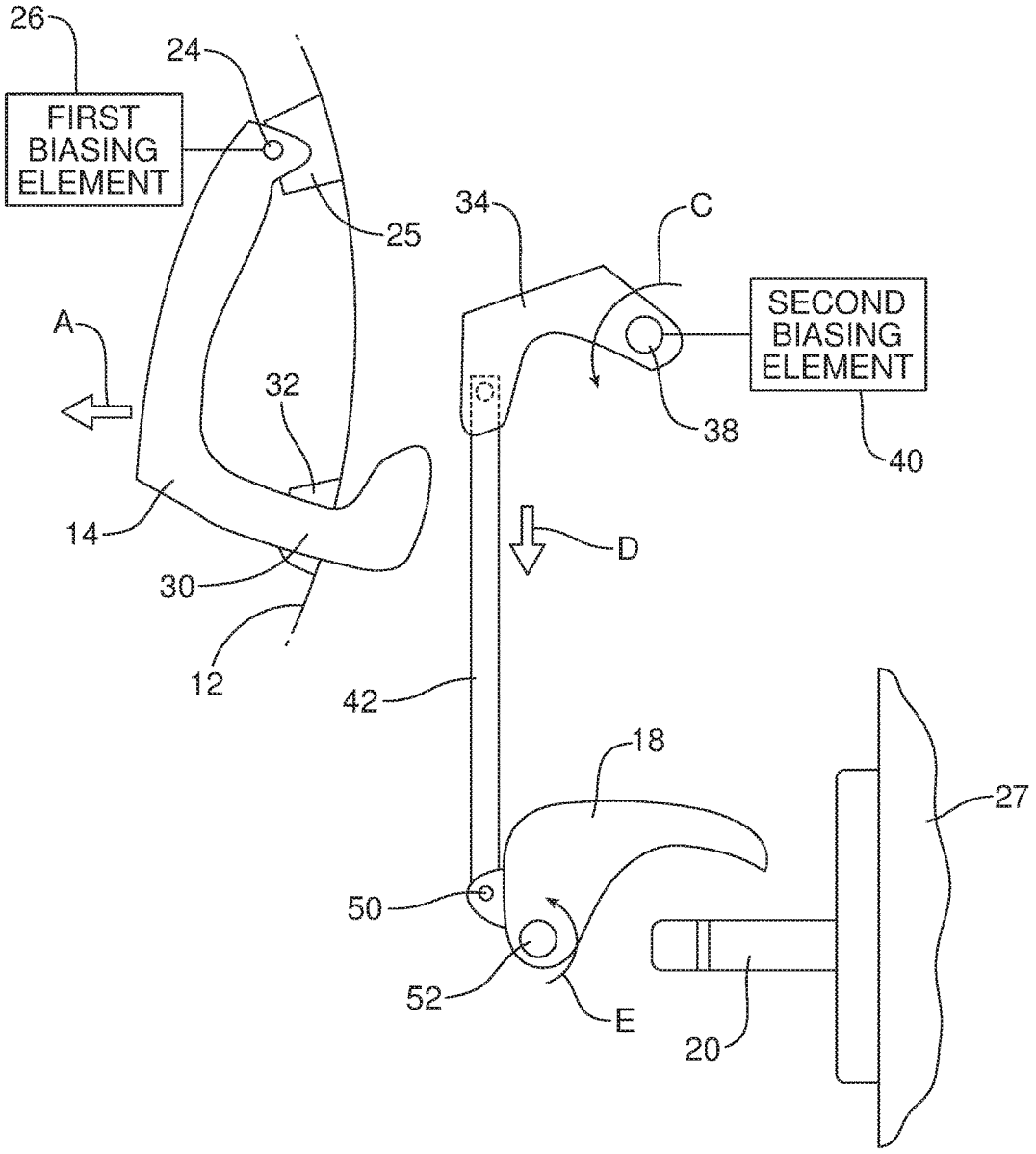
FIG. 2 is a schematic illustration similar to FIG. 1 but showing the unlatching of the door by the pulling of the handle.

As should be apparent from viewing FIGS. 1 and 2 in combination, a user displaces the handle 14 from the latching position illustrated in FIG. 1 to the first unlatching position illustrated in FIG. 2 by pulling the handle in the direction of action arrow A. In contrast, as should be apparent from viewing FIGS. 1 and 3 in combination, a user displaces the handle from the latching position illustrated in FIG. 1 to the second unlatching position illustrated in FIG. 3 by pushing the handle 14 in the direction of action arrow B.

The mechanical connection feature 22 includes a mechanical cam 34 carried in the door 12. That mechanical cam 34 has a second cam surface 36 that engages the first cam surface 28 on the distal end of the handle 14. The mechanical cam 34 is pivotally mounted to the door 12 by a second pivot 38 and is displaceable between a first position illustrated in FIG. 1 and a second position illustrated in FIGS. 2 and 3. A second biasing element 40, such as a torsion spring concentrically received over the pivot 38, functions to bias the mechanical cam 34 toward the second position thereby ensuring contact between the second cam surface 36 and the first cam surface 28.

Figure 3:
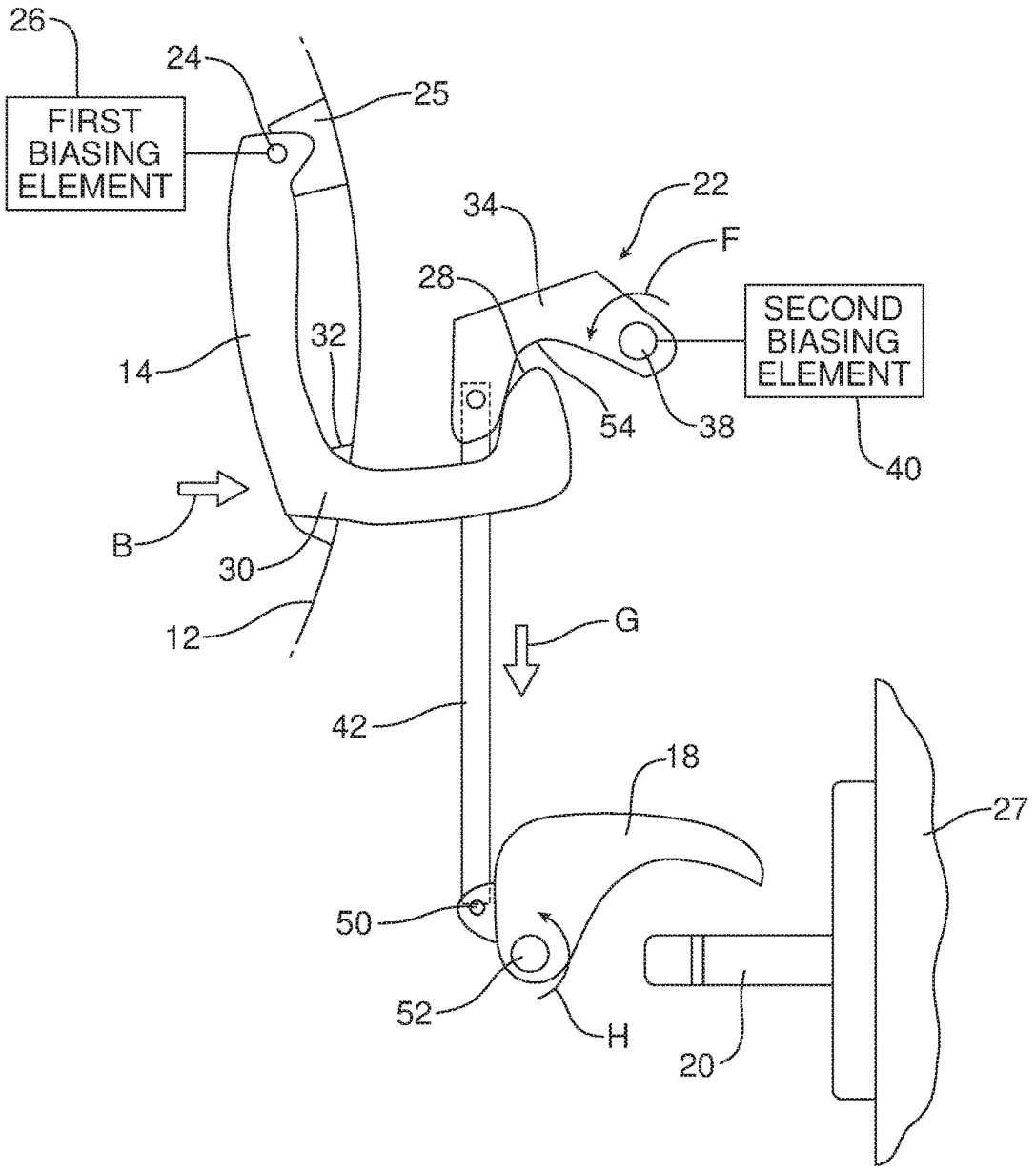
FIG. 3 is a view similar to FIGS. 1 and 2 but illustrating the unlatching of the door by the pushing of the handle.

As further illustrated in FIGS. 1-3, the mechanical connection feature 22 also includes a link 42 having a first end 44 connected to the mechanical cam 34 by a pivot pin 46 and a second end 48 connected to the latch 18 by a pivot pin 50. Here it should be appreciated that the link 42 may be connected between the mechanical cam 34 and the latch 18 by other appropriate means.

The latch 18 includes a third pivot 52 that connects the latch to the door 12. The latch 18 is displaceable between a door latching position wherein the latch is in engagement with the receiver 20 as illustrated in FIG. 1 and a door unlatching position wherein the latch 18 is free of the receiver 20 as illustrated in FIGS. 2 and 3.

Operation of the operating system 10 will now be described in detail. When a user approaches the motor vehicle, the door 12 is closed and latched as illustrated in FIG. 1. The user may open the door 12 as illustrated in FIG. 2 by pulling the handle 14 in the direction of action arrow A against the biasing force of the first biasing element 26. The intermediate portion 30 of the handle 14 freely slides through the support 32 as this is done. This pulling movement disengages the first cam surface 28 at the distal end of the handle 14 from the second cam surface 36 of the mechanical cam 34. As a result, the second biasing element 40 rotates the mechanical cam 34 in the direction of action arrow C (note FIG. 2) about the second pivot 38 until the mechanical cam reaches the second position as shown. This displacement of the mechanical cam 34 causes link 42 to be displaced in the direction of action arrow D. The displacement of the link 42 functions to displace the latch 18 in the direction of action arrow E about the third pivot 52 into the unlatching position free of the receiver 20 carried (again see FIG. 2). This unlatching of the latch 18 frees the door 12 to be opened.

In the alternative, when a user approaches a closed and latched door as illustrated in FIG. 1, the user may push on the handle 14 in the direction of action arrow B against the force of the first biasing element 26 (see FIG. 3). As this is done the intermediate portion 30 of the handle 14 slides freely through the support 32 and the first cam surface 28 slides across the second cam surface 36 of the mechanical cam 34. As this is done, the second biasing element 40 provides a biasing force that functions to pivot the mechanical cam 34 in the direction of action arrow F. The concavity 54 provided in the mechanical cam 34 accommodates the first cam surface 28 and distal end of the handle 14 providing the necessary clearance to allow the pivoting movement.

As the mechanical cam 34 pivots about the second pivot 38 in the direction of action arrow F, the link 42 is displaced in the direction of action arrow G causing the latch 18 to be pivoted about the third pivot 52 in the direction of action arrow H moving from the latching position illustrated in FIG. 1 to the unlatching position illustrated in FIG. 3 wherein the latch is free of the receiver 20. This unlatches the door 12 for opening.

Figure 4:
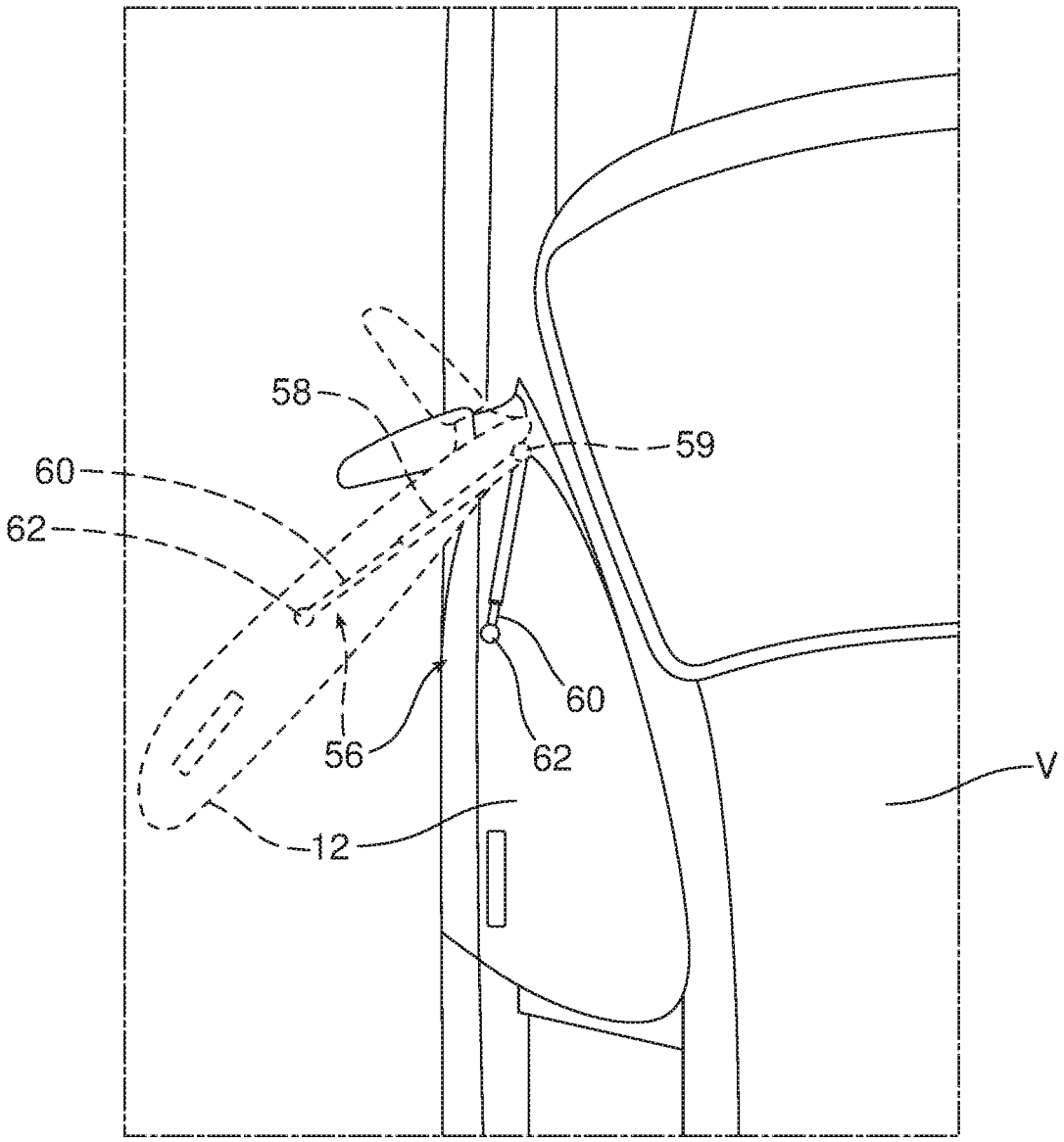
FIG. 4 is a schematic top plan view of a motor vehicle equipped with the operating system of FIGS. 1-3 and illustrating an actuator for opening the door once it has been unlatched.

FIG. 4 illustrates a motor vehicle V equipped with the operating system 10 shown in FIGS. 1-3. That operating system 10 may also include an actuator 56 to swing the motor vehicle door 12 open when the latch 18 has been displaced to the unlatching position whether this is done by pulling the handle as illustrated in FIG. 2 or pushing the handle as illustrated in FIG. 3. The actuator 56 may, for example, be a dampener such as a gas strut illustrated in FIG. 4 or assume any other appropriate structure suited to provide a door opening function. As shown, when the door is unlatched, the actuator displaces the door 12 from the closed position illustrated in full line in FIG. 4 to the open position illustrated in phantom line in FIG. 4. More specifically, the illustrated actuator 56 includes a body 58 pivotally attached to the motor vehicle V at the pivot 59 and an extendable arm 60 pivotally attached to the door 12 at the pivot point 62.

Whether the latch mechanism 16 has been unlatched by pulling on the handle 14 as illustrated in FIG. 2 or pushing on the handle 14 as illustrated in FIG. 3, when a user releases the handle, the first biasing element 26 biases the handle back into the home or latching position illustrated in FIG. 1. As this is done, the first cam surface 28 at the distal end of the handle 14 contacts the second cam surface 36 on the mechanical cam 34 displacing the mechanical cam about the pivot 38 and returning the mechanical cam to the first position illustrated in FIG. 1. This in turn displaces the link 42 in the direction of action arrow I illustrated in FIG. 1 which in turn pivots the latch 18 in the direction of action arrow J about the third pivot 52 thereby displacing the latch into a latching position where the latch engages the receiver 20 thereby latching the motor vehicle door 12 closed.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. An operating system of a motor vehicle door, comprising:

a handle displaceable between a latching position, a first unlatching position and a second unlatching position;

a latch mechanism including a latch and a cooperating receiver; and a mechanical connection feature connecting said handle to said latch whereby said motor vehicle door is unlatched by displacing said handle.

2. The operating system of claim 1, wherein said handle includes a first pivot, a first cam surface and a first biasing element biasing the handle toward said latching position.

3. The operating system of claim 2, wherein said mechanical connection feature includes a mechanical cam having a second cam surface engaging said first cam surface, said mechanical cam being displaceable between a first position and a second position.

4. The operating system of claim 3, wherein said mechanical cam includes a second pivot and a second biasing element biasing said mechanical cam toward said second position.

5. The operating system of claim 4, wherein said mechanical connection feature includes a link having a first end connected to said mechanical cam and a second end connected to said latch.

6. The operating system of claim 5, wherein said latch includes a third pivot and is displaceable between a door latching position in engagement with said receiver and a door unlatching position disengaged from said cooperating receiver.

7. The operating system of claim 6, further including an actuator to swing said motor vehicle door open when said latch is in said unlatching position.

8. A motor vehicle, comprising:

a chassis;

a door carried on said chassis and displaceable between a closed position and an opened position; and an operating system for said door including (a) a handle displaceable between a latching position, a first unlatching position and a second unlatching position, (b) a latch mechanism including a latch and a cooperating receiver and (c) a mechanical connection feature connecting said handle to said latch whereby said door is unlatched by displacing the handle.

9. The motor vehicle of claim 8, wherein said handle, said latch and said mechanical connection feature are carried on said door and said cooperating receiver is carried on said chassis.

10. The motor vehicle of claim 9, wherein said handle includes a first pivot, a first cam surface and a first biasing element biasing the handle toward said latching position.

11. The motor vehicle of claim 10, wherein said mechanical connection feature includes a mechanical cam having a second cam surface engaging said first cam surface, said mechanical cam being displaceable between a first position and a second position.

12. The motor vehicle of claim 11, wherein said mechanical cam includes a second pivot and a second biasing element biasing said mechanical cam toward said second position.

13. The motor vehicle of claim 12, wherein said mechanical connection feature includes a link having a first end connected to said mechanical cam and a second end connected to said latch.

14. The motor vehicle of claim 13, wherein said latch includes a third pivot and is displaceable between a door latching position in engagement with said receiver and a door unlatching position disengaged from said cooperating receiver.

15. The motor vehicle of claim 14, further including an actuator to swing said door open when said latch is in said unlatching position.

16. The motor vehicle of claim 8, wherein said latching position is between said first unlatching position and said second unlatching position.

17. The motor vehicle of claim 16, wherein said handle passes through a support carried on said door.

18. A method of unlatching a motor vehicle door including a pivoting handle, comprising:

pivoting said pivoting handle from a latching position either in a first direction to a first unlatching position or in a second direction to a second unlatching position; and unlatching a latch for said motor vehicle door via a mechanical connection feature.

19. The method of claim 18, including pushing or pulling on said pivoting handle to unlatch said motor vehicle door.

20. The method of claim 19, including opening said motor vehicle door when unlatched by an automatic door opening feature.

* * * * *